United States Patent [19]

Behrendt et al.

[11] 4,431,109

[45] Feb. 14, 1984

[54] BOOM EXTENSION STOWAGE SYSTEM

[75] Inventors: Joseph W. Behrendt, Sioux City, Iowa; John D. Evans, Nicholasville; James W. Cox, Jr., Lexington, both of Ky.

[73] Assignee: FMC Corporation, Chicago, Ill.

[21] Appl. No.: 238,290

[22] Filed: Feb. 25, 1981

[51] Int. Cl.[3] ..... B66C 23/62

[52] U.S. Cl. ..... 212/177; 212/187; 212/188; 212/222

[58] Field of Search ..... 212/175, 176, 177, 182, 212/184, 187, 188, 222, 228

[56] References Cited

U.S. PATENT DOCUMENTS

| | | | |
|---|---|---|---|
| 3,366,250 | 1/1968 | Grove . | |
| 3,521,759 | 7/1970 | Gardenhour . | |
| 3,572,517 | 3/1971 | Liebherr et al. . | |
| 3,698,569 | 10/1972 | Lamar . | |
| 3,732,988 | 5/1973 | Lamar . | |
| 3,785,505 | 1/1974 | Keller . | |
| 3,804,264 | 4/1974 | Hedeen et al. | 212/222 |
| 3,831,771 | 8/1974 | Wiencek | 212/55 |
| 3,856,151 | 12/1974 | Lamar | 212/55 |
| 3,944,082 | 3/1976 | Fritsch . | |
| 3,968,884 | 7/1976 | Johnson et al. | 212/55 |
| 4,043,253 | 8/1977 | Albright et al. | 212/222 |
| 4,045,923 | 9/1977 | Shanmugasundaram | 52/118 |
| 4,091,936 | 5/1978 | Wuerflein et al. . | |
| 4,106,631 | 8/1978 | Lundy . | |
| 4,141,455 | 2/1979 | Henderson | 212/55 |
| 4,155,464 | 5/1979 | Hogg . | |
| 4,318,488 | 3/1982 | Rathi | 212/177 |

*Primary Examiner*—Trygve M. Blix
*Assistant Examiner*—Stephen P. Avila
*Attorney, Agent, or Firm*—A. J. Moore; R. B. Megley

[57] ABSTRACT

A multi-section crane boom is provided with a fly section and a jib section which may be erected and supported by a mast and pendants on the end of the boom to extend the effective length of the boom. When the fly section and jib section are not used they are stored on the boom, the fly section being supported alongside of and generally parallel to the boom and the jib section being supported in position below the fly section. The fly section can be mounted on the end of the boom alone while the jib section remains in stored position, or, alternatively, the fly section can be mounted on the boom and the jib section can be mounted on the outer end of the fly section. A pair of compact hook shaped resilient connectors serve as backstops which prevent the fly from pivoting in excess of 5° upwardly past longitudinal of alignment with the boom axis when the boom is in a near vertical position. The resilient connectors also permit easy attachment of the pendants when slack, and further act as shock absorbers during stowage of the fly and during pivotal erection of the jib relative to the fly in the event the components of the crane are improperly adjusted or the operator negligently operates the machine.

12 Claims, 18 Drawing Figures

FIG_1
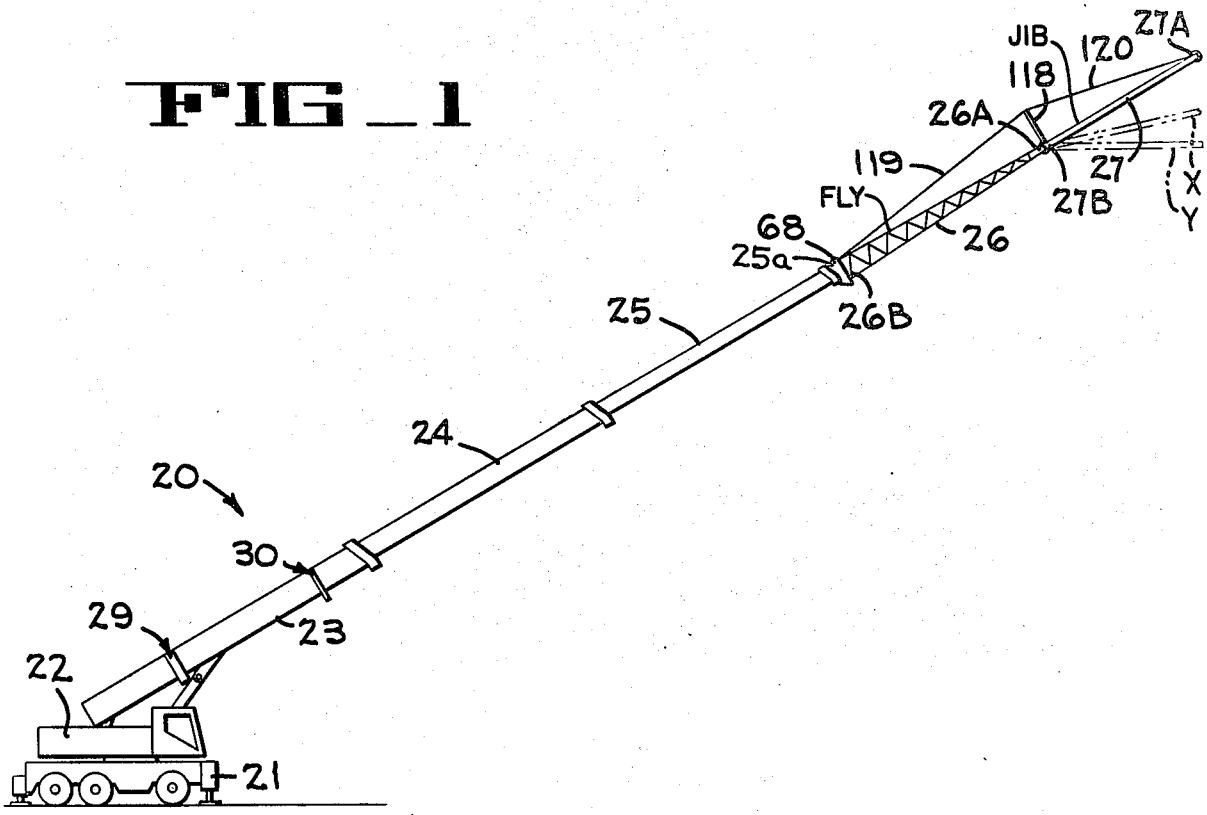
FIG_2
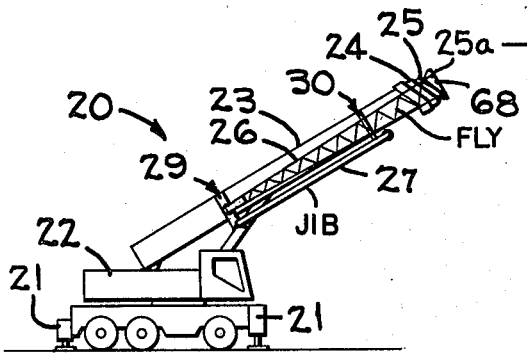
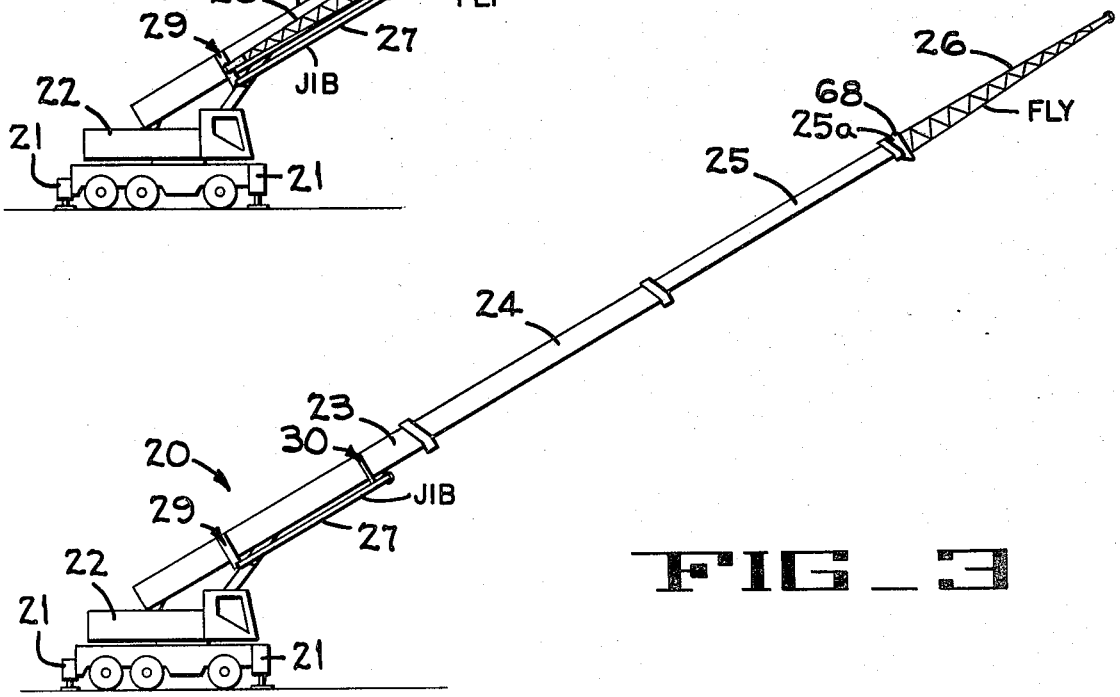
FIG_3

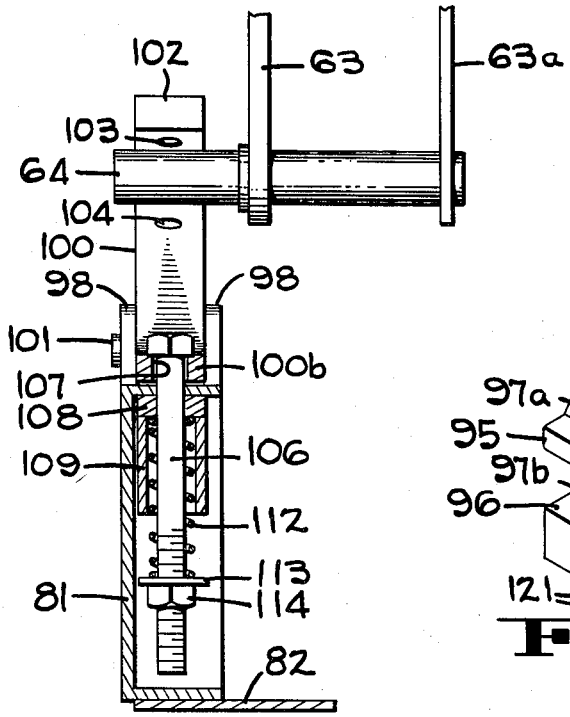
FIG_8
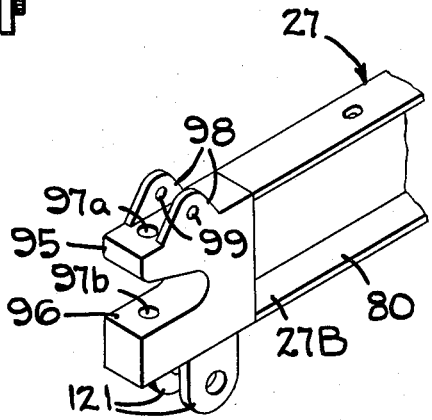
FIG_10
FIG_9
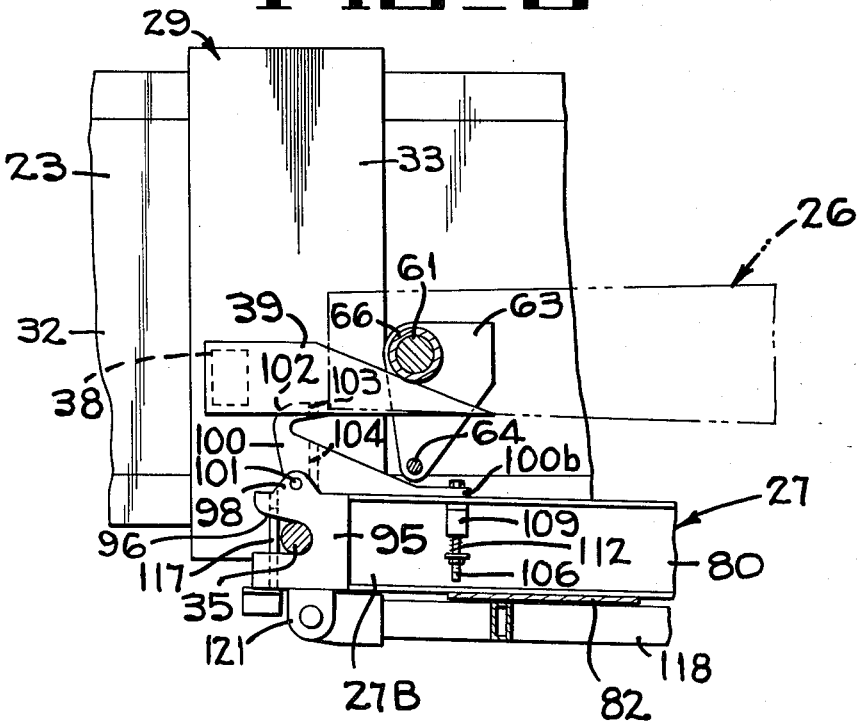

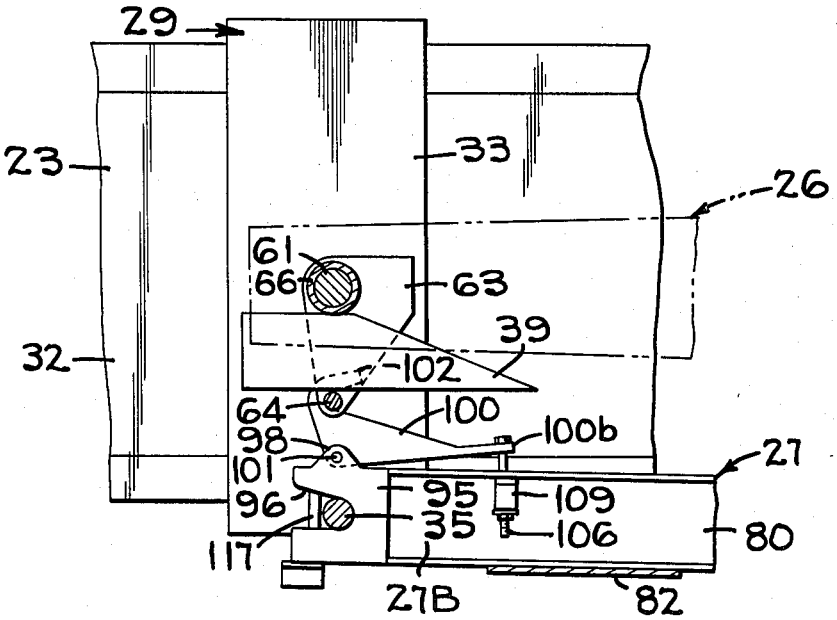
FIG_11
FIG_12
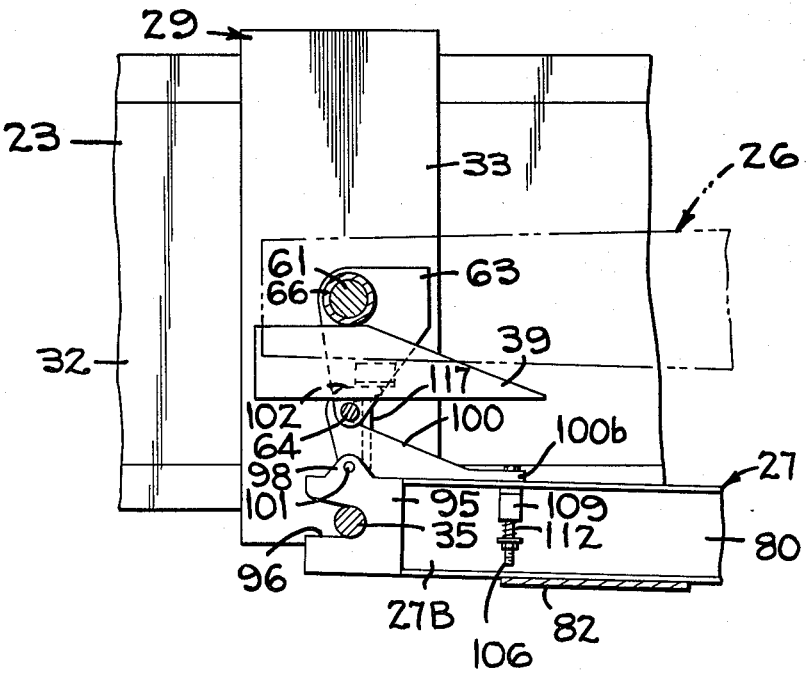

BOOM EXTENSION STOWAGE SYSTEM

BACKGROUND OF THE INVENTION

This invention relates to apparatus for increasing the effective length of the boom of a crane, and more particularly to improved methods of and apparatus for erecting boom extensions and storing them when not in use.

It has been proposed to provide two extension units for a multi-section telescopic boom which can be used if desired or can be stowed in brackets on the boom when not in use. In the arrangement disclosed in U.S. Pat. No. 4,091,936 one unit, which is identified as a fly and is stored alongside the boom, is arranged to be pivotally connected to the forward end of the outermost boom section and swung around to a position of alignment with the boom. The second unit, called a jib, underlies the fly when both the fly and the jib are in stowed position on brackets on the boom and is arranged to be pivotally connected, if desired, to the fly so that it will swing outwardly with the fly when the fly is swung to the aligned position, and then can be swung downwardly and outwardly relative to the fly in a generally vertical plane until it too reaches aligned position with the boom. Various other arrangements for increasing the effective length of a crane boom and for storing boom extension units are disclosed in U.S. Pat. Nos. 3,366,250; 3,732,988; 4,106,631; 4,141,455; and 4,155,464.

Since this type of equipment is very heavy and difficult to maneuver, the storing of the extension units and the moving of them relative to each other is particularly difficult and improved mechanisms in these areas are desirable.

In addition, regulatory codes require that a backstop device be provided between a fly and jib, when erected, to prevent the jib from pivoting upwardly relative to the fly in excess of 5° above the longitudinal axis of the fly and boom. Heretofore, jibs that have been supported on flys at the ends of booms by pendant lines and mast, and have required expensive and somewhat cumbersome backstop devices to prevent the jib from rebounding or swinging upwardly in excess of 5° above the centerline of the boom when the boom is raised to a near vertical position. Backstops in the form of tubular telescopic struts which are connected at an angle between the fly and the upper end of the mast are known. These struts are arranged to bottom out when the maximum permissible upward swing of the jib has been reached.

SUMMARY OF THE INVENTION

The present invention provides brackets on one side of the base section of the boom which are adapted to support the forward and rearward end of the jib in stowed position. A fly overlies the jib and when moved to stowed position, it is also supported by brackets extending from the base section of the boom. When the fly is to be used without the jib, it is pivotally connected to the forward end of the outermost or manual section of the boom and is then moved outwardly with that section away from the jib and is subsequently pivoted into alignment with and rigidly connected to the manual section of the boom. If the fly and the jib are both to be used, the innermost ends (when stowed) of the fly and the jib are pinned together so that as the fly is pulled outwardly by the outwardly moving boom section, it pulls the jib outwardly with it. The pinned connection of the fly and the jib also provide a pivot joint on which the jib can pivot in a vertical plane relative to the overlying fly. After the fly has been swung horizontally to a position of alignment with the boom and has been rigidly connected to the manual section, the jib can be swung in a vertical plane to an operative position substantially in alignment with the fly.

When the jib is being swung in a vertical plane around the outer end of the fly, the forward end is first gently lowered to the ground by a hand operated winch in a conventional manner. Thereafter, the operator raises the boom until the jib moves forwardly past the vertical and then lowers the forward end of the boom toward the ground causing the fly to extend forwardly into alignment with the jib. If the operator does not stop the boom at the proper moment, detrimental impact is apt to occur but is minimized by resilient hook-shaped connectors.

When the fly is used without the jib, the jib remains in stowed position on the boom. Then, when the fly is moved toward stowed position and into engagement with the jib, the resilient hook shaped connectors provides a shock-absorbing safety feature which absorbs the impact if the crane components are not properly adjusted and the operator does not stop movement of the fly at the proper time.

Other important functions of the unique resilient connectors are to act as an aid when assembling the jib to the fly in substantial axial alignment with the boom by permitting the jib to be pivoted about 5° past axial alignment with the boom thereby permitting the jib supporting pendant lines to be connected when slack. Thereafter, the resilient connectors act as resilient backstops which will positively prevent the pendant supported jib from pivoting in excess of 5° upwardly relative to the longitudinal axis of the boom.

In accordance with this invention, a method of maneuvering the fly and the jib during the jib erecting operation is provided. This method involves the well known steps of lowering the boom, disconnecting the forward end of the jib from the fly and lowering it to the ground by a winch or the like until the sheave at the free end of the jib rests on the ground, then elevating the boom causing the jib to swing outwardly with the sheave rolling on the ground. As soon as the jib passes a vertical position, lowering the boom causing the jib to continue its outward swinging movement as the sheave continues to roll along the ground. The new steps of the method occur after the jib reaches a position of alignment with the fly. At this time the downward movement of the boom is continued thereby pivoting the resilient hook connector a maximum of about 10° relative to the jib thus providing slack in the jib supporting pendant lines. The pendant lines are then connected to the jib when slack, and the boom is raised lifting the jib from the ground and causing the resilient connectors to return to their normal positions with the jib being supported by a shaft or sleeves and pendant lines.

DESCRIPTION OF THE DRAWINGS

FIG. 1 is a diagrammatic side elevation of a crane having the boom extension units of the present invention mounted on the outer end of the boom.

FIG. 2 is a diagrammatic side elevation of the crane of FIG. 1 showing the boom in retracted position and the jib and fly units mounted in stowed position on the boom.

FIG. 3 is a diagrammatic side elevation of the crane of FIG. 1 showing the fly in erected position and the jib in stowed position.

FIG. 8 is a vertical section taken along line 8—8 of FIG. 5.

FIG. 9 is a vertical section taken along line 9—9 of FIG. 6.

FIG. 10 is a fragmentary isometric of an end portion of one of the side beams of the jib, the beam being shown disconnected from its associated mechanism for clarity.

FIGS. 11 and 12 are vertical sections similar to FIG. 9 showing different operating positions of the mechanism.

DESCRIPTION OF THE PREFERRED EMBODIMENT

Figure 4:
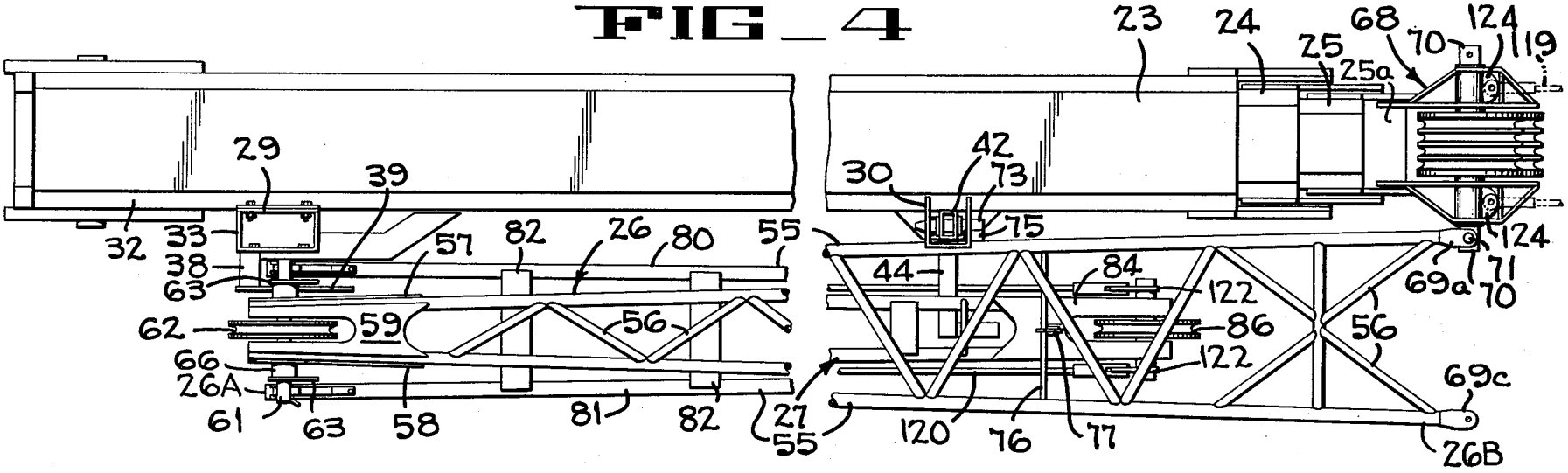
FIG. 4 is a fragmentary plan view of the crane of FIG. 1 showing the jib and the fly in stowed position on the boom.

In FIG. 1, the reference number 20 indicates generally a crane, which incorporates the features of the present invention and comprises a wheeled vehicle having a plurality of stabilizer jacks 21 and a superstructure 22 mounted for rotation about a generally vertical axis, in a conventional manner. A boom is pivotally mounted on the superstructure and includes a base section 23, an inner mid-section 24, and an outer mid-section 25 and a manual section 25*a*. Two extensions 26 and 27 are mounted on the end of the boom, extension 26 being referred to hereinafter as a fly section and extension 27 being referred to as a jib section.

In FIG. 1, both the fly 26 and the jib 27 are shown in erected position on the boom. In this specification, the outermost end of the jib in erected position will be called the outer end and indicated by reference numeral 27A while the inner end will be indicated as 27B. Similarly, the outer end of the fly will be indicated by numeral 26A and the inner end will be designated 26B. In FIG. 3, the fly 26 is shown erected, while the jib 27 remains in stored position, and in FIG. 2 both the fly and the jib are in stored position.

Figure 5:
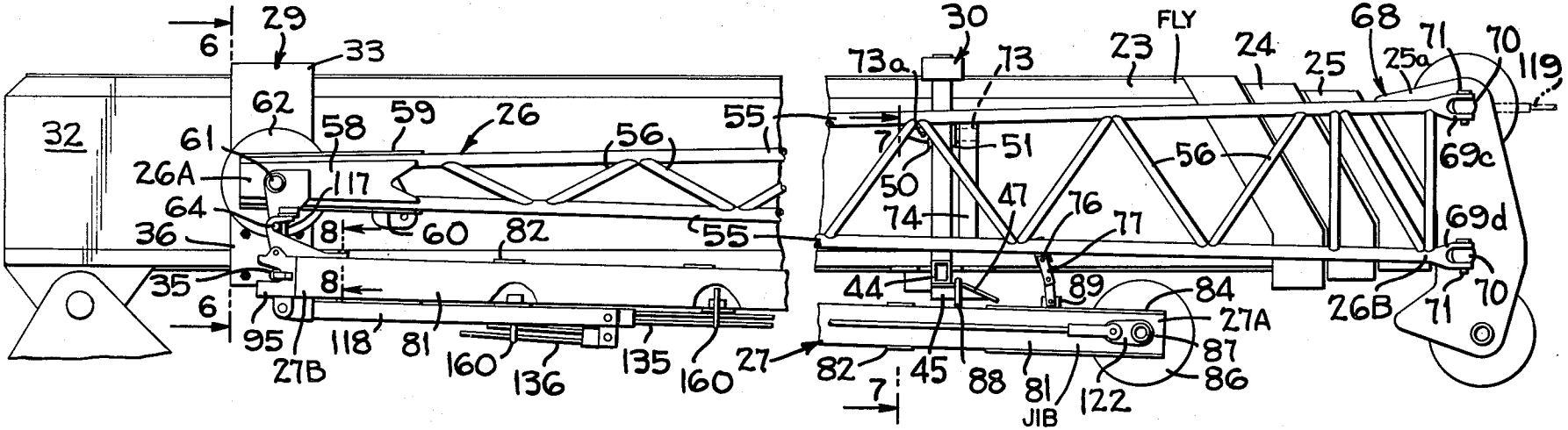
FIG. 5 is a fragmentary side elevation of the apparatus of FIG. 4.
Figure 6:
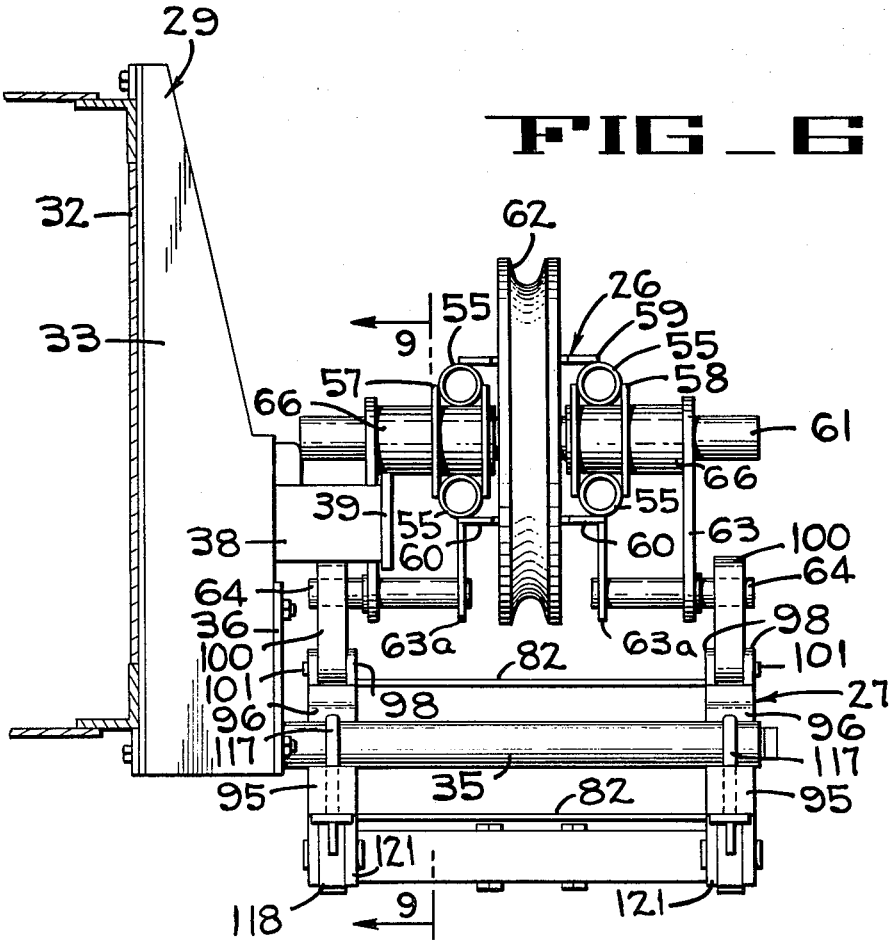
FIG. 6 is a fragmentary vertical section taken along the line 6—6 of FIG. 5.
Figure 13:
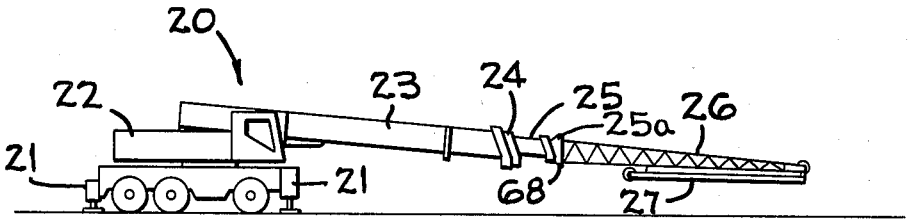
FIGS. 13–15 are diagrammatic views showing parts of the sequence followed in erecting the jib on the fly.

When the fly and jib are in stored position they are supported on the base section 23 of the boom by means of brackets 29 and 30 (FIG. 4) which are mounted in longitudinally spaced relation on base section 23. The base section 23 is an elongated boom section of generally rectangular cross-section within which the other boom sections are telescopically received as indicated in FIGS. 2, 4 and 5. The base section 23 includes a side wall 32 (FIG. 6) to which a vertically oriented channel 33 of bracket 29 is bolted. Near its lower end, the channel 33 carries an outwardly projecting cylindrical rod 35 which is connected to channel 33 by a plate 36. At a point spaced above rod 35, the channel carries a short, outwardly projecting tube 38 which is of rectangular cross-section and has a cam plate 39 (FIG. 9), that extends generally parallel to the boom, secured to its outer face.

Figure 7:
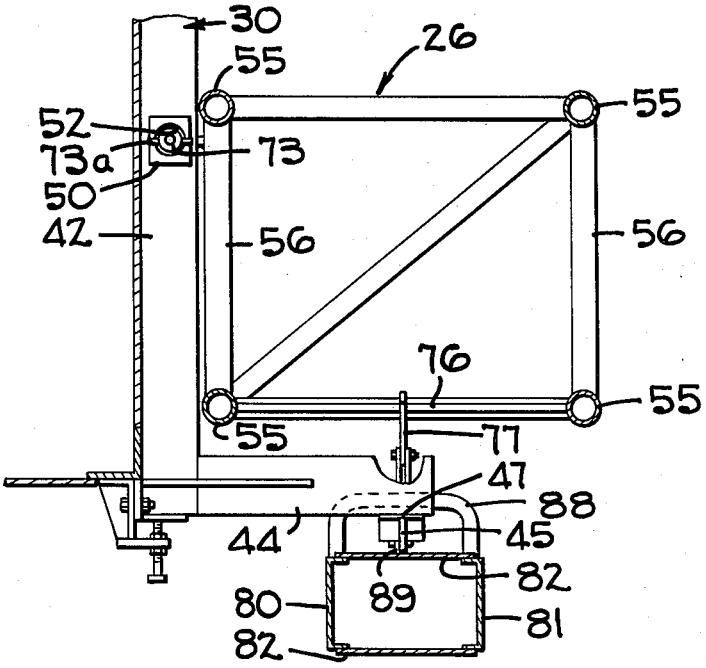
FIG. 7 is a vertical section taken along line 7—7 of FIG. 5.

The bracket 30 (FIGS. 5 and 7) comprises a channel 42 secured, as by bolts, to the base section 23 and extending downwardly along the side of the boom. Near its lower end, the channel carries an outwardly projecting tube 44 which is of rectangular cross-section and has a vertical strip 45 welded to its undersurface. As seen in FIG. 5, the strap 45 extends generally parallel to the base section 23 and carries a cam plate 47 at its outer end in downwardly slanted position. Near its upper end, the channel 42 is provided with reinforcing plates 50 and 51 (FIG. 5) on its opposite walls, each plate having a circular opening 52 (FIG. 7) overlying a somewhat larger hole in the adjacent wall of the channel, the opening 52 in the plate 50 being in alignment with the opening 52 in plate 51.

The fly 26 (FIG. 5) is an elongated lattice type member made up of four tubes 55 held in spaced relation by rigid diagonal tubular braces 56 that are welded between the tubes to define a structure that is wider at the inner end 26B than at the outer end 26A. Two side plates 57 and 58 and top and bottom plates 59 and 60 (FIG. 6) are also welded between the tubes 55 at the outer end 26A to rigidify that end. An axially aligned pair of sleeves 66 are rigidly secured to adjacent side plates 57,58 and to adjacent upper and lower tubes 55 and carry a shaft 61 on which a sheave 62 is rotatably journaled in a conventional manner. Each sleeve 66 also carries a downwardly-extending plate 63, which with the aid of a short plate 63*a* that is secured to the bottom plate 60, carries and rigidly supports an outwardly-projecting rod 64. As will be explained presently, the sleeve 66 is supported on the cam plate 39 when the fly is in stowed position, and the rods 64 are part of a mechanism for pivotally connecting the fly to the jib and for locking the jib relative to the fly when in operative position as shown in FIG. 1.

At the inner end 26B of the fly, the four tubes 55 are provided with yokes 69*a*–69*d* each of which has a pair of vertically aligned holes. When the fly is in the stowed position, the yokes 69*a* and 69*b* (only yoke 69*a* shown in FIG. 4) of the two vertically aligned tubes 55 that are closest to the boom are loosely received by the ends of two pivot arms 70 extending laterally from the boom head 68 on the outermost or manual boom section 25*a*. When the fly is to be moved into operating position, pins 71 are inserted through each yoke 69*a* and 69*b* and the associated arm 70. The fly is then swung counterclockwise (FIG. 4) on the axis defined by the two pins 71 to a position at which the yoke 69*c* and 69*d* on the other side of the fly receive the ends of the two vertically aligned pivot arms 70 on that side of the boom head. Additional pins, like pins 71, are then inserted in the aligned holes of the yokes 69*c* and 69*d* and the associated pivot arms 70 to lock the fly in extended position.

At a point spaced from the inner end 26B, the fly carries a positioning pin 73 which is a bullet shaped member that is attached to two of the tubes 55 of the fly by a vertical tube 74 (FIG. 5) and a generally horizontal plate 75 that is welded to the tube 74 and to the pin 73. As will be explained more fully presently, when the fly is moved to the stowed position of FIGS. 4 and 5, the pin passes through the aligned openings 52 in the plates 50 and 51 carried by the boom bracket 30. A locking pin 73*a* extends through a hole in the pin 73 near the forward end to lock the pin to the bracket.

Also near the inner end 26B, a tube 76 extends transversely across the fly between two tubes 55, and a link lock 77 which is made up of three pivotally interconnected links is pivotally mounted in depending position on the rod.

The jib 27 (FIGS. 4 and 5) comprises two horizontally-spaced, vertically-oriented channels 80 and 81 connected by a plurality of plates 82 welded across their upper and lower surfaces and, at the outer end 27A of the jib, the channels are connected by a slotted plate 84. It will be noted that the jib is wider at inner end 27B than it is at the outer end 27A which rotatably carries a sheave 86 on a shaft 87. Near its outer end, the jib also carries a rigid transverse metal jib supporting loop 88 that is secured to and extends upwardly from the channels 80 and 81. A short plate 89 (FIG. 5) which is welded to and projects upwardly from the transverse plate 84, has an aperture therethrough for receiving a pin to connect the link lock 77 to the jib.

At the inner end 27B of the jib, a forked block 95 (FIG. 10) is welded to the end of each channel 80 and 81 to project away from and form an extension of the channel. Each block has a socket 96 in its outermost end and aligned holes 97*a* and 97*b* in the arms defining the socket. A pair of ears 98 project upwardly from the block 95 and these ears have openings 99 therethrough. The openings 99 in the ears of each block are aligned with each other transversely of the channel. A pair of hook shaped levers 100 (FIG. 9) serves as a resilient connector and provides several protective functions. Each lever 100 is pivotally mounted beween each pair of ears by a pin 101 extending through the aligned openings. Each lever has a hook member 102 formed at one end, and aligned holes 103 and 104 are drilled in the space sections of the lever that define a socket at the base of the hook. Each lever also has an arm 100*b* which has a flattened undersurface that rests on the upper surface of the associated channel 80 or 81. A bolt 106 (FIG. 8) extends through an aperture 107 in the arm 100*b* and through aligned openings in the upper flange of the channel, in a channel washer 108, and through a cylindrical spring guide retainer 108 which is secured in inverted position on the underside of the flange of the channel to receive in guiding relation a coil spring 112 that surrounds the bolt. A washer 113, which is held on the bolt by a nut 114, receives the lower end of the spring in supporting relation.

When the jib is stored on the boom section 23 as seen in FIG. 9, the sockets 96 of the two blocks 95 at the end of the channels 80 and 81 receive the rod 35 that projects laterally from the vertical channel 33 of bracket 29. At that time the jib supporting loop 88 near the outer end 27A (FIG. 5) of the jib is resting on the cam plate 47, and rod 64, carried by the outer end 26A of the fly, is disposed in the socket provided by the hook 102 on the corresponding side of the jib. A pin 117 is disposed in the aligned holes 103,104 of each hook to lock rods 64 in the sockets and thereby secured the end of the fly to the jib. At this time, the positioning pin 73 (FIGS. 4 and 5) is locked in the bracket 30.

Referring to FIG. 1 it will be seen that when the jib 27 is mounted on the end of the fly 26, a strut 118 is in place and a set of back-stay pendant lines 119 are connected between the boom head 68 and the strut. A set of front-stay pendants 120 is connected between the strut 118 and the outer end of the jib. When the jib is in the stowed position of FIG. 5, the strut 118 is pivoted about axes through ears 121 (FIG. 10) on the channel 80 and is folded up against the jib with the pendant lines stored between the channels 80 and 81 of the jib.

It will be understood that, when the crane is put into operation with the various boom sections and the boom extensions of the present invention or when the boom extensions are changed between stowed and operating positions, certain conventional safety procedures are used.

If the boom is to be used without the fly or jib, the boom is pivoted upwardly to a desired angular position, the inner mid-section 24 is moved outwardly of base section 23, and outer mid-section 25 is moved outwardly of section 24 by conventional power cylinders (not shown) operatively connected to the sections. The manual section 25*a* may either remain retracted as illustrated in FIGS. 1 and 3, or be extended outwardly of the outer mid-section 25*a* by conventional means. Since the pins 71 (FIGS. 4 and 5) are not, at this time, disposed in the yokes 69 of the fly, the fly will not move outwardly with section 25 but will remain in position locked on the boom section 23 by locking pin 73*a* (FIG. 5) and on the jib by pin 117.

When it is desired to use the fly but not the jib, the boom sections are retracted to the inner position of FIG. 5, and pins 71 are put in place through the yokes 69*a* and 69*b* (FIG. 4) of the tubes 55 closest to the boom and through the associated arms 70 on the boom head 68. The link lock 77 is disconnected from the plate 89 on the jib. The pin 73*a* is withdrawn from the nose of the bullet-shaped positioning pin 73. The pins 117 are withdrawn from the upper holes 103,104 (FIG. 9) of each hook 100 and inserted in the holes 97*a* and 97*b* of the blocks 95 thus releasing the fly from the jib. The manual boom section 25*a*, and the outer mid-section 25 are then moved outwardly from section 24 to withdraw the pin 73 from the bracket 30 and move the rods 64 of the fly out of engagement with the hooks 100 of the jib. When the fly is clear of the boom and the jib, it is swung counterclockwise (FIG. 4) to a position of alignment with the boom section 25, with the yokes 69*c* and 69*d* on the outer tubes straddling the arms 70 on the far side of the boom head. Pins 71 are then inserted through the yokes 69*c* and 69*d* and associated arms 70 to lock the fly in outwardly-extending operating position.

To return the fly to its stowed position, the above procedure is reversed in the following manner. With the boom section 24 fully retracted and the manual section 25*a* fully retracted within section 25 but extending a short distance out of boom section 24, the pins 71 through yokes 69*c* and 69*d* are removed, and the fly is pivoted clockwise to bring it to a position alongside the boom section 23, with the positioning pin 73 disposed a short distance forwardly of the bracket 30 in alignment with the openings 52. At this time, each rod 64 on the outer end of the fly is positioned near the base of the associated hook 100 on the jib. The section 25 and 25*a* are then retracted into section 24, moving the pin 73 into the holes 52 in the bracket 30, and causing the shaft 61 to engage and ride upwardly along the upwardly-extending cam surface of cam 39 as seen in FIG. 9. It will be noted that as the shaft 61 moves along cam 39, the rods 64 are carried into the sockets provided by the hooks 100.

If the system is properly adjusted, full retraction of boom sections 24,25 and 25*a* will move the rods 64 into exact registered engagement with the hooks 100 so that the pins 117 may be easily placed in the holes in the hook as indicated in FIG. 12. However, if the system is out of adjustment and the operator moves the boom inwardly too far, each rod 64 is, in effect, an abutment that may engage the associated hook with considerable impact. However, if this occurs, the shock is cushioned by the counterclockwise pivoting of the hook 100 about pin 101 against the resistance of the spring 112 as seen in FIG. 11. The pins 117 are then positioned across the ends of the hooks 100; the pin 73*a* is inserted in the nose of the pin 73; and the link-lock 77 is reconnected to plate 89.

Figure 14:
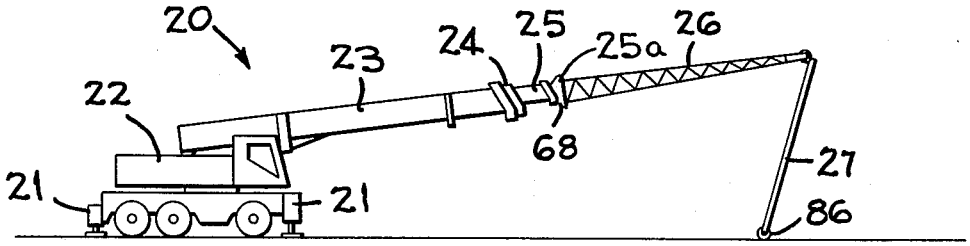
Figure 15:
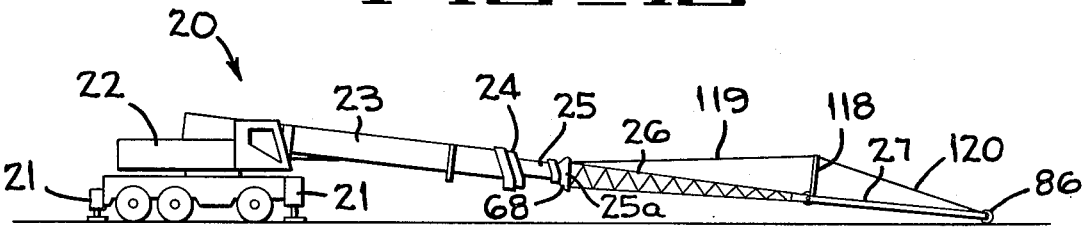

When the fly and the jib are in stowed position and it is desired to use both the fly and the jib, the pins 117 are allowed to remain in the holes 103,104 of each hook 100 as seen in FIG. 12. Then, when the pins 71 have been inserted through the yokes 69*a* and 69*b* and the associated arms 70, and the locking pin 73*a* is withdrawn from pin 73, the boom section 25 is moved out of boom section 24 a distance sufficient to withdraw the bullet-shaped pin 73 from the bracket 30. During this movement, the rods 64 that are carried by the fly act through the pins 117 to cause the jib to move along the boom until the loop 88 of the jib moves out of engagement with the forwardly-projecting strap 45. With the boom level, the fly and the jib are then swung as a unit around the boom head to align the fly with the boom. When the pins 71 have been inserted through yokes 69*c* and 69*d* to lock the fly in aligned position, a winch is connected between the fly and the jib, and the jib is pivoted upwardly slightly to relieve the tension on the link-lock 77. The link-lock is then disconnected and the jib is winched downwardly to allow the sheave 86 to move into engagement with the ground. The boom is then raised to allow the sheave 86 to roll along the ground, pivoting the jib counterclockwise (FIG. 14) on the fly. When the momentum of the swinging jib causes it to pass a vertical position, the boom is moved downwardly, causing the sheave to continue its movement outwardly until it reaches the position of FIG. 15 in alignment with the fly.

Figure 16:
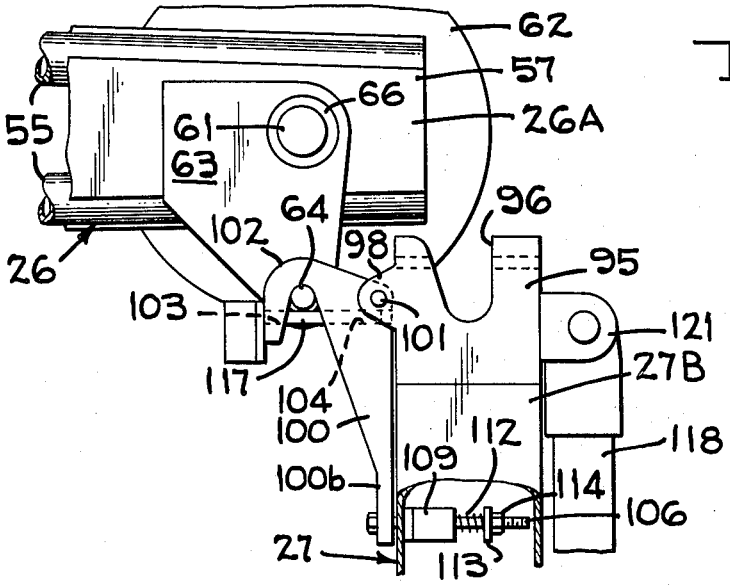
FIGS. 16–18 are fragmentary side elevations, with parts broken away, of the pivotally connected ends of the fly and the jib, the views illustrating a sequence of movements of the ends during the jib-erecting operation.
Figure 17:
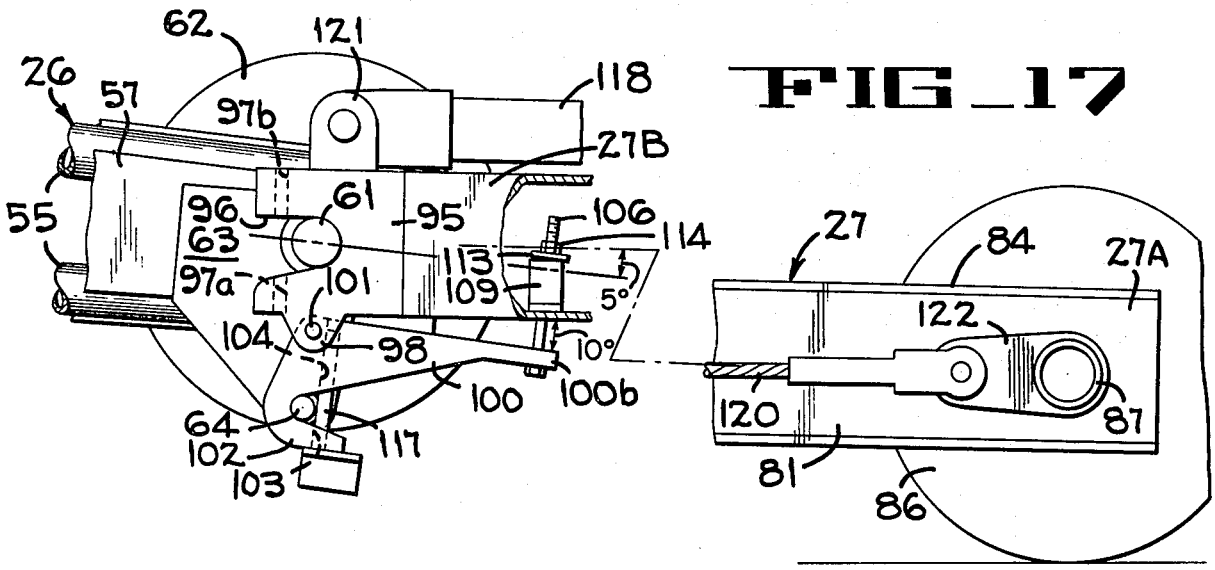
Figure 18:
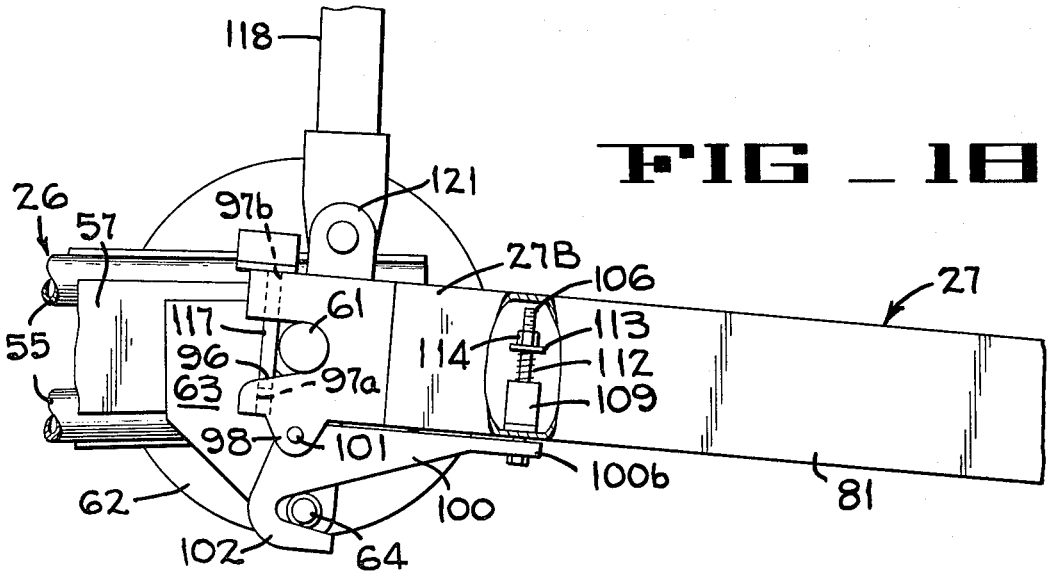

FIGS. 16, 17 and 18 are fragmentary operational views showing the action of the jib 27 as it moves to a position of alignment with the fly 26. As the jib 27 pivots counterclockwise (FIG. 16), the sockets 96 at the forward end of the block 95 on each channel of the jib move into engagement with the shaft 61. Since the boom is a very heavy member, it develops a considerable amount of momentum as it moves downwardly and its downward movement is difficult to stop precisely. Accordingly, the sockets 96 may engage the abutment shaft 61 with some degree of force. As seen in FIG. 17, the aligned pivot pins 101 allow the levers 100 to pivot slightly (about 10°) relative to the channels 80 and 81 of the jib, thus allowing the jib to rotate slightly around shaft 61. As the levers 100 pivot, their movement is resisted by the springs 112 carried in the housings 109, and thus the two spring units cushion the impact of the engagement of the jib and the fly. When the jib has settled back to its generally aligned position (FIG. 18), the pins 117 are withdrawn from the holes 103 and 104 of each hook 100 and inserted in the holes 97*a* and 97*b* of the block 95 to lock the jib on the fly.

When the jib has been locked in the aligned position, the pins which lock the front and back stay pendants 120 and 119 to the jib are removed. While in the stowed position, the inner ends of these pendants remain connected to the upper end of the strut 118 (FIG. 1) and the outer end of the front stay pendants 120 remain secured to two connectors 122 (FIGS. 4 and 5) that are pivotally mounted on the shaft 87, one adjacent the outer face of channel 80 and the other adjacent the outer face of channel 81. The mast or strut 118 is then erected and the inner ends of the two back stay pendants 119 are connected in apertured horizontal plates 124 (FIG. 4) on the boom head 68.

It will be understood that when the spring loaded levers 100 engage the rods 64 as illustrated in FIGS. 11 and 17, the rods 64 will fully seat within the cavities of the levers 100, and the shaft 61 will fully seat within the sockets 96. This full seating permits easy transfer of the pins 117 between the holes 97*a*,97*b* and the holes 103,104 without interference with either the shaft 61 or the rods 64.

The nut 114 and washer 113 (FIG. 17) of the previously described spring loaded lever system 100 cooperates with the retainer 109 to act as a stop. The stop permits the longitudinal axis of the jib 27 to pivot no more than about 5 degrees (FIG. 17) in a counterclockwise direction relative to the axis of the fly 26 when the jib and fly are connected in operative position as illustrated in solid lines in FIG. 1. The stop function of the levers 100 prevent the jib from accidentally pivoting rearwardly over the crane when the boom is in a near vertical position. Also, when the jib 26 is pivoted the maximum amount as illustrated in FIG. 17, the pendants 119 and 120 (FIG. 15) may be easily connected in operative position since they are slack.

From the foregoing description it will be evident that the present invention provides an efficient method of erecting a jib on the end of a fly by using the vertical oscillation of the boom and the momentum of the swinging jib to effect an alignment of the jib and the boom. The spring-loaded hook connectors provide a simple stop device which prevents the pendant supported jib from pivoting in excess of 5° upwardly and rearwardly of the boom axis when the boom is in the near vertical position. Also, the hook connectors provide easier connection and disconnection of the pendant lines, and further act as shock absorbers if certain machine components are improperly adjusted or if the operator improperly controls the machine during storage or erection of the jib and fly.

Although the best mode contemplated for carrying out the present invention has been herein shown and described, it will be apparent that modification and variation may be made without departing from what is regarded to be the subject matter of the invention as defined in the appended claims.

What we claim is:

1. In combination with an elongated crane boom defined by a plurality of sections including a fly and a jib connectable to the fly by a socket for pivotal movement in a vertical plane about a pivot shaft, a mast extending upwardly from one of said boom sections, pendant lines connected between two sections of the boom and the mast for supporting jib from downward pivotal movement relative to the boom; the improvement which comprises abutment means on said fly, means defining a resilient hook shaped connector supported by said jib adjacent said pivot shaft and movable into abutting engagement with said abutment means for pivotally supporting the jib on said fly, said connector being effective to allow a limited amount of upward pivotal movement of the jib relative to the fly initially about said abutment means and thereafter about said pivot shaft after the socket engages said pivot shaft and to positively stop such movement at about 5° above the longitudinal axis of the boom.

2. An apparatus according to claim 1 wherein said resilient connector means includes a pair of hook shaped levers pivoted on said jib, spring guide means of predetermined length connected between said levers and said jib for allowing a limited amount of pivotal movement between said lever and said jib, and prestressed spring means on said guide for resiliently urging said lever against said jib for allowing about 10° of pivotal movement relative to said jib before being positively stopped.

3. In combination with a crane boom; a first and second support member secured to and projecting laterally from said boom at points spaced longitudinally along said boom; a jib in supported engagement on said support members; a third support member projecting laterally from said boom at an elevation higher than said first and second members; a fourth support member secured to said crane boom and disposed adjacent and above said first support member; a fly supported on said third and fourth support members of said boom; jib connector means movably supported on said jib; and means for selectively connecting or disconnecting said connector means with said fly and said first support member when said jib is supported on said first and second support members; each jib connector means comprises a pair of apertured hooks mounted in spaced relation on said jib, each hook including spaced sections defining a socket opening toward the front of the boom, and said connecting means including pins selectively engageable in the apertures of said hooks to lock said fly on said jib when in said engaged position and permitting said fly to be moved into said sockets or out of said sockets toward the front of the boom and out of stowed position when said pins are disengaged from said apertures.

4. In combination with a crane boom, a first and second support member secured to and projecting laterally from said boom at points spaced longitudinally along said boom, a jib supported on said support members, a third support member projecting laterally from said boom at an elevation higher than said first and second support members, a fourth support member having a ramp secured to said boom and disposed adjacent to and above said first support member, a fly, means for moving said fly along said boom above said jib into supporting engagement with said third and fourth boom supporting members, and resilient jib connector means movably supported on said jib, said ramp being effective to guide and thereafter support one end portion of said fly in coupling position engaging said connector means of said jib in response to movement of said fly along said boom in one direction, said resilient connector means deflecting to minimize impact forces in the event said fly moves a distance in said one direction greater than that required to move into coupling position with said connector means.

5. The combination of claim 4 wherein said fly includes a pair of laterally spaced abutments, and said jib connector means includes sockets for receiving said abutments.

6. The combination of claim 5 wherein said connector means of said jib includes ramps for guiding said abutments into said sockets, and means for locking said abutments in said sockets.

7. The combination of claim 5 wherein said connector means of said jib comprises a pair of levers pivoted at one end on said jib, each lever having a socket at one end.

8. In combination, a first crane boom section; a second boom section; pivot means connecting the end portions of said sections; means providing abutment surfaces on said sections adapted to engage each other when one of said sections is pivoted into a position of substantial alignment with the other section; resilient means for resisting the impact of said abutment members as they come into engagement; said resilient means including a pair of levers, each lever having two arms, a pin disposed between said arms and pivotally connecting each said lever to an end portion of said boom section, and means defining a socket on one of said levers of each arm; an abutment on an end portion of the other of said boom sections adapted to enter into said sockets for pivotally supporting one of said boom sections for movement through approximately 180° relative to the other boom section, and means for maintaining said abutment in said sockets during said pivotal movement.

9. The combination of claim 8 wherein the means providing abutment surfaces on said first boom section comprises a shaft projecting laterally from each side of said first boom section, and the means providing abutment surfaces on said second boom section comprising a pair of spaced blocks carried at the end of said second boom section, and means defining an outwardly-opening socket in each block adapted to receive a portion of said shaft, the engagement of said shaft in said sockets providing a pivot axis for pivoting of said second boom section relative to said first boom section after said shaft is disposed in said sockets, said resilient means including said lever means pivotally connected to said second boom section, and adapted to pivot about said pin upon engagement of said shaft in said sockets.

10. In a crane having an elongated boom having a longitudinal axis with a fly connected to the outer end of the boom and with a jib having a first socketed end adapted to be connected to the end of the fly for further extending the operative length of the boom; the improvement which comprises connector means for pivotally connecting the jib to the fly and for resiliently minimizing impact forces between the fly and the jib during movement of the jib into boom extending position; said connector means including first and second pivot shafts secured to and projecting transversely of the longitudinal axis of the boom, hook means resiliently and movably supported on one end of said jib having a hook socket opening toward the opposite end of said jib and pivotally supported on said second shaft for movement about said second shaft between a position out of alignment with said boom axis and a position in substantial alignment with said boom axis with said first socket contacting said first pivot shaft with sufficient impact forces to move said resilient hook means relative to said jib for minimizing impact forces, means connected between said fly and said jib for supporting the jib from downward pivotal movement relative to the fly after first moving said jib socket into position to contact said first pivot shaft, and releasable retaining means for retaining said second shaft in said hook socket until said first socket is in abutting contact with said first pivot shaft and thereafter transferring said retainer means to a position retaining said first pivot shaft in said first socket.

11. An apparatus according to claim 10 wherein said hook means comprises a lever pivoted to said jib, and resilient means normally urging said lever in one direction into abutting engagement with said jib, said lever being pivoted in the opposite direction in response to being subjected to said impact forces.

12. An apparatus according to claim 1 wherein said hook means acts as a resilient stop to prevent said jib from pivoting in the direction opposite to said downward pivotal movement by inertia forces acting on said fly when said boom is raised to near vertical position.

* * * * *